United States Patent [19]

Leach

[11] 4,419,651

[45] Dec. 6, 1983

[54] HIGH VOLTAGE CURRENT LIMITING FUSE HAVING A FUSE ELEMENT SUSCEPTIBLE TO OXIDATION AND ESPECIALLY SUITED FOR HIGH OPERATING TEMPERATURES

[75] Inventor: John G. Leach, Hickory, N.C.

[73] Assignee: General Electric Company, King of Prussia, Pa.

[21] Appl. No.: 391,772

[22] Filed: Jun. 24, 1982

[51] Int. Cl.[3] ..... H01H 85/04

[52] U.S. Cl. ..... 337/159; 337/228; 337/246

[58] Field of Search ..... 337/186, 202, 227, 158, 337/159, 228, 290, 246

[56] References Cited

U.S. PATENT DOCUMENTS

| | | | |
|---|---|---|---|
| 3,723,930 | 3/1973 | Koch | 337/158 |
| 3,921,116 | 11/1975 | Mikulecky | 337/202 |
| 4,271,343 | 6/1981 | Danchin | 337/186 X |
| 4,323,873 | 4/1982 | Nounen et al. | 337/186 |
| 4,349,803 | 9/1982 | Tobin | 337/186 |

*Primary Examiner*—George Harris

*Attorney, Agent, or Firm*—William Freedman; John P. McMahon

[57] ABSTRACT

A high voltage fuse with an element operating at relatively high temperatures and having such element comprised of a metallic material which is highly susceptible to oxidation at such temperatures is disclosed. The fuse element has predetermined dimensions so as to have a predetermined time-current characteristic. The high voltage fuse has a sealed environment for housing the fuse element. The fuse element has a thickness dimension sufficiently great so that any oxide layer that may accumulate on the fuse element over a service period of 15 years does not significantly affect the predetermined time-current characteristic of the fuse element during the period.

4 Claims, 2 Drawing Figures

HIGH VOLTAGE CURRENT LIMITING FUSE HAVING A FUSE ELEMENT SUSCEPTIBLE TO OXIDATION AND ESPECIALLY SUITED FOR HIGH OPERATING TEMPERATURES

BACKGROUND OF THE INVENTION

This invention relates to electric fuses, and more particularly, to a high voltage current limiting fuse operated at high temperatures and having a fuse element comprised of a metallic material that is highly susceptible to oxidation when exposed to such high temperatures.

High voltage fuses for interrupting a wide range of currents are well known in the art. One such high voltage fuse is described in U.S. Pat. application Ser. No. 270,032 J. G. Leach et al, filed June 3, 1981, now U.S. Pat. No. 4,357,588 and assigned to the same assignee of the present invention, and herein incorporated by reference.

It is generally a requirement of current limiting fuses that the quantity $I^2t$ required to melt the element be kept to a low level. The quantity $I^2t$ is meant to represent the product of the square of the current ($I^2$) conducted by the fuse element multiplied by a duration (t). In order that this quantity be held at a low value, highly conductive materials such as silver, copper, and aluminum have commonly been used for the fuse element.

Although copper is a desired material for fuse elements its potential usage has been somewhat restricted. The copper material is primarily used for "cool running fuses". The term "cool running fuses" is meant to represent fuses whose fusible element(s) operating temperatures are relatively low such as a temperature within the range of 25° to 125° C. The usage of the copper material as a fuse element is severely limited in hot running fuses. "Hot running" fuses is a term commonly used to signify those fuses having fusible element(s) operating temperature which exceeds the previously mentioned temperature range of 25° C. to 125° C. for considerable periods of time (many hours).

The limitation of the copper material to cool running fuses is primarily created by oxidation problems. The copper is highly susceptible to oxidation when it is exposed to a high operating temperature such as 200° C. The high operating temperature tends to require the use of metals such as silver, platinum, iridium, and other expensive non or low oxidizing materials. It is desired from an economic viewpoint that a relatively inexpensive material such as copper be adapted to be used in hot running high voltage fuses even though such materials are highly susceptible to oxidation at high temperatures.

SUMMARY

Accordingly, it is an object of the present invention to adapt copper and similar materials for usage as fuse elements in hot running fuses.

It is a further object of the present invention to provide means so that the operating life of the fuse element such as copper is substantially extended over a period of time.

These and other objects of this invention will become apparent to those skilled in the art upon consideration of the following description of the invention.

In accordance with one embodiment of the present invention a high voltage current limiting fuse is provided. The high voltage current limiting fuse is especially suited for high operating temperatures and has a fuse element comprised of a metallic material such as copper which is highly susceptible to normal oxidation conditions. The fuse element has a predetermined time-current characteristic and a predetermined thickness dimension. The high voltage fuse has a sealed casing formed of a relatively non-porous material so as to provide a sealed environment for the fuse element severely limiting oxygen diffusion into the casing. The fuse element has a thickness dimension sufficiently great that the oxide layer that may accumulate onto the fuse element over a period of 15 years does not significantly affect the predetermined time-current characteristic of the fuse element during the period. The seal of the casing is sufficiently effective that the oxygen entry rate is significantly limited over a 15 year period to limit the thickness of any such oxide layer to less than approximately 2 percent of the thickness dimension of the fuse element.

The features of the invention believed to be novel are set forth with particularity in the appended claims. The invention, itself, however, both as to its organization and method of operation, together with further objects and advantages thereof, may be best understood by reference to the following description taken in conjunction with the accompanying drawings.

DETAILED DESCRIPTION OF THE PREFERRED EMBODIMENT

Figure 1:
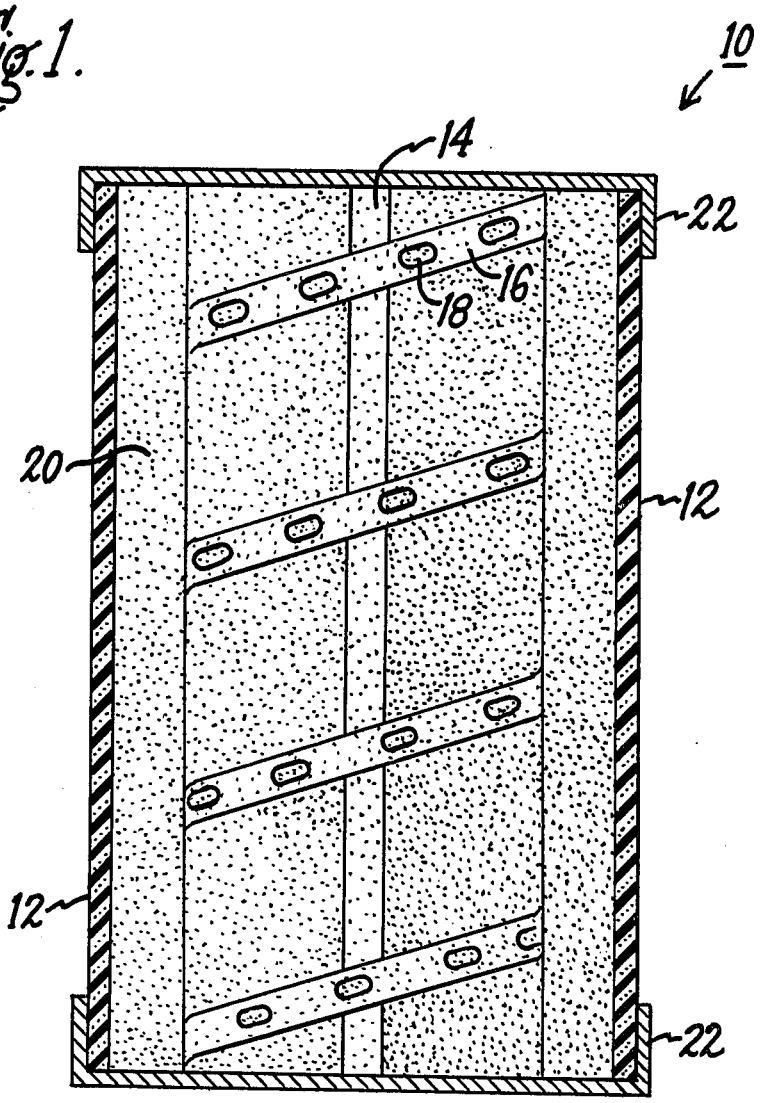
FIG. 1 shows an exposed view of a high voltage fuse having the fuse element wrapped around a supporting core.

FIG. 1 shows a cross-section of a high voltage fuse 10 exemplifying one embodiment of the present invention. FIG. 1 shows a supporting core 14 having wrapped around and in contact with it a single fuse element 16. The supporting core 14 may be of a star-shaped type. The fuse element 16 has a plurality of perforations or cutouts 18 along its length. The FIG. 1 further shows the high voltage fuse of the present invention as having a casing 12 which contains a highly pulverulent dielectric material 20 such as sand.

While FIG. 1 shows only a single fuse element 16, it is to be understood that this invention comprehends a fuse 10 construction in which a plurality of fuse elements 16 are electrically connected in parallel. The fuse element 16 may be wrapped around its supporting core 14 as shown in FIG. 1, which is within the tubular insulating housing 12, and has electrical terminals 22 at its opposite ends. The high voltage fuse element 16 provides an electric circuit between these terminals 22. Still further, the type of fuse is not limited to a high voltage type; a low voltage fuse is equally applicable and comprehended by this invention. Also the high voltage fuse 10 may be of the type not having a supporting core. For such a type, fuse element 16 is connected between the electrical terminals located at the opposite ends of the high voltage fuse and reference may be had to U.S. Pat. No. 3,294,936 issued Dec. 27, 1966 to H. W. Mikulecky, for such a showing. This latter patent is herein incorporated by reference.

The fuse element 16 is of a ribbon-type. The fuse element 16 has a plurality of cutouts or perforations 18. These perforations or cutouts 18 primarily determine the desired time-current characteristics of the high voltage fuse. The dimensions of the cutout 18 which primarily determine the desired time-current characteristic are not considered part of this invention but reference may be had to the previously incorporated by reference U.S. patent application Ser. No. 270,032 for details of determining the desired cutouts for time-current characteristics of the fuse element 16. This invention primarily relates to the use of a metal material, such as copper, having a high susceptibility oxidation particularly manifested at a relatively high operating temperature such as 200° C.

As discussed in the "Background" a metallic material such as copper is desired to be used in hot running fuses. However, the oxidation problems caused by operating these fuses at the high temperatures of hot running fuses typically prevent the desired operation of the high voltage fuse. The usage of a metallic material such as copper for a fuse element subjected to a high temperature environment in a range of 125° to 250° C. commonly causes a brittle, weakly adherent oxide layer to be created on its surfaces in a rapid manner such as might result in a 1% loss of conducting material in one to two months.

The oxide formation is initially in the form of a relatively tenacious film of cuprous oxide. However when this layer gets thicker (over approximately 125 nm) the oxide forms as black cupric oxide. This cupric oxide is very brittle and if the fuse is subjected to thermal cycling, it flakes off, exposing fresh copper which is then oxidized to reinitiate this cycle. This results in loss of element thickness and a hotter running element. Eventually the fuse would melt open even at rated current.

The present invention relates to adapting materials, such as copper, that are susceptible to formation of a weakly-adherent oxide layer, for use in a hot running fuse. The invention relates, in part, to providing a fuse casing 12 constructed of relatively-non-porous materials such as copper, brass, steel, glass reinforced epoxy, ceramic, epoxy or other similar non-porous or limited porous materials. The non-porous casing 12 provides a sealed environment for the fuse element 16 which severely limits oxygen diffusion into the environment. The fuse element 16 is so sealed that the oxygen diffusion onto the fuse element through its casing is severely limited under moderate pressure differentials which typically occur in practice and which are in the order of 1 atmosphere or less. This severely limited oxygen diffusion cooperates with the structure of the fuse element 16 so as to provide a fusible device that may be successfully operated over a long period of time, such as 15 years.

The fuse element 16 has dimensions such that the limited amount of oxygen present inside the fuse casing 12 when it is sealed, plus any oxygen which diffuses into the casing 12 due to pressure differentials produced by the natural heating and cooling of the fuse assembly 10, does not permit sufficient oxidation of the fuse element 16 so as to significantly affect successful fuse assembly 10 operations during its anticipated life somewhat greater than 15 years. The fuse element 16 is not significantly hindered or affected so as to alter the predetermined time current characteristic of the fuse element 16 during the 15 year period. More particularly, the fuse element 16 has a thickness dimension such that its successful operation is not hindered by any oxide layer that may accumulate on the fuse element over this 15 year period. The oxide layer that hinders successful operation is one that may cause a significant change in the time-current characteristic of the fuse element 16, i.e., a change in melting current of about 5 percent for a given time.

Furthermore, for a fuse element 16 to provide its desired protection the oxide layer should not lead to premature fuse operation or prevent successful short circuit clearing. By the terms "premature fuse operation" and "successful short circuit clearing" it is respectively meant melting of the fuse element at a current equal to or less than its rated current and successfully interrupting a current between the maximum interrupt rating and the minimum interrupt rating of the fuse. In accordance with the principles of this invention it has been found that all criteria for successful operation of fuse 10 have been met when the oxidation layer on the fuse element 16 is limited to a relatively thin layer having a thickness of no more than 2 percent of the metal thickness. In order that this oxide layer may be more fully described relative to the fuse element 16, reference is now made to FIG. 2.

Figure 2:
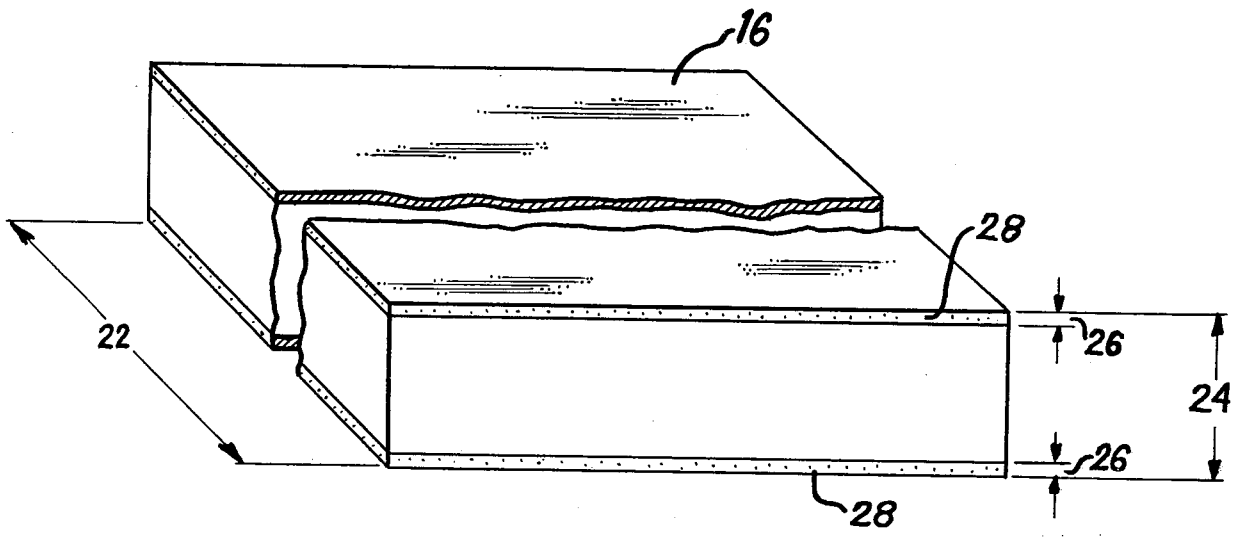
FIG. 2 shows the fuse element of FIG. 1 in an enlarged manner.

FIG. 2 shows fuse element 16 as having a width dimension 22 typically having a value of 5 mm and thickness dimension 24 typically having a value of 0.6 mm. Further, FIG. 2 shows an oxide layer 28 on the top and the bottom surfaces of the fuse element 16. The oxide layer 28 occurs on all the surfaces of the fuse element but the oxide layer on the top and bottom surfaces is the most significant. The oxide layer 28 is shown to have a thickness dimension 26. The thickness dimension 26 is typically less than two (2) percent of the thickness dimension 24. Limiting the relative thicknesses to this proportion provides for the hereinbefore given successful operation of the high voltage current limiting fuse operating at the relatively high temperatures.

In the practice of this invention it has been realized that diffusion rates which have been effective at limiting oxygen ingress are those measured for helium using a Helium Detecting Mass Spectrometer, a 5% helium mixture and a leak rate of about $1\times10^{-6}$ ml/sec/atm. The Helium Detecting Mass Spectrometer may be the type 120SSA available from E. I. DuPont DeNemours of Wilmington, Del. It has been determined by test and analysis that the limitation of these diffusion rates into casing 14 is sufficiently effective such that the oxygen entry rate is sufficiently limited over a period of 15 years to limit the thickness dimension 26 to its previously discussed desired value.

A second embodiment of the present invention is provided which extends the fuse life still further than the 15 years. The second embodiment accomplishes increases to the capabilities of the high voltage fuse by initially excluding oxygen from the casing 12. This may be accomplished by first filling the casing 14 with a suitable non-oxidizing gas, for example, nitrogen, helium, argon, or mixtures thereof. The exclusion of oxygen from the initial filling of the casing 14 may increase the operating life of the fuse element 16 by a substantial factor such as 15 additional years.

Although the fuse element 16 has been described as being of a copper material, if desired, other suitable materials which are susceptible to the formation of a brittle, weakly adherent oxide coating at high operating temperatures may be used in the practice of this invention.

As previously mentioned, this invention is not limited to a high voltage fuse. A low voltage fuse is comprehended by the practice of this invention in accordance with the description given hereinbefore.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim is:

1. A hot-running current limiting fuse for running at high operating temperatures in the range of 125° to 250° C. and having a fuse element of a metallic material which in the presence of free air is highly susceptible under said high temperature conditions to the formation thereon of a brittle weakly-adherent oxide coating, said fuse element having a predetermined time-current characteristic and a predetermined thickness dimension, said current limiting fuse comprising a sealed, non-porous casing enclosing the fuse element so as to provide a sealed environment for the fuse element and so as to severely limit oxygen diffusion into said environment, a pulverulent filler within the casing in which the fuse element is located, a gas within the casing in which said element and filler are located, said gas being of such a character as to make no significant improvement in the corona performance of the fuse as compared to the fuse's corona performance with free air therein, said fuse element having a thickness dimension sufficiently great that the oxide layer that may accumulate onto said fuse element over a period of 15 years in service does not significantly affect said predetermined time-current characteristic of the fuse element during said period, the seal of the casing being sufficiently effective that the oxygen entry rate is sufficiently significantly limited over said 15 year period to limit the thickness of any such oxide layer to less than approximately 2 percent of the thickness dimension of said fuse element.

2. A current limiting fuse according to claim 1 wherein said sealed casing is filled with a non-oxidizing gas.

3. A current limiting fuse according to claim 2 wherein said non-oxidizing gas includes as a major component either nitrogen, helium, argon, or a mixture thereof.

4. A current limiting fuse according to claims 1, 2, or 3, wherein said fuse element is primarily of copper.

* * * * *